US009380672B2

(12) United States Patent
Hussain et al.

(10) Patent No.: US 9,380,672 B2
(45) Date of Patent: Jun. 28, 2016

(54) METHODS AND APPARATUS FOR IMPROVING BACKLIGHT DRIVER EFFICIENCY

(71) Applicant: Apple Inc., Cupertino, CA (US)

(72) Inventors: Asif Hussain, San Jose, CA (US); Jingdong Chen, San Jose, CA (US); Mohammad Jafar Navabi-Shirazi, Cupertino, CA (US); Manisha Pandya, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 685 days.

(21) Appl. No.: 13/754,640

(22) Filed: Jan. 30, 2013

(65) Prior Publication Data

US 2014/0159614 A1 Jun. 12, 2014

Related U.S. Application Data

(60) Provisional application No. 61/734,906, filed on Dec. 7, 2012.

(51) Int. Cl.
*H05B 33/08* (2006.01)
*G09G 3/34* (2006.01)

(52) U.S. Cl.
CPC ..... *H05B 33/086* (2013.01); *G09G 3/3406* (2013.01); *H05B 33/0863* (2013.01); *G09G 2320/041* (2013.01); *G09G 2320/062* (2013.01); *G09G 2320/064* (2013.01)

(58) Field of Classification Search
CPC ..... G09G 2320/062; G09G 2320/064; G09G 3/3406; H05B 33/086; H05B 33/0863
USPC ..... 315/219, 307, 297, 302, 300; 345/214, 345/38, 44, 87; 362/97.1–97.3, 561
See application file for complete search history.

(56) References Cited

U.S. PATENT DOCUMENTS

2010/0020004 A1 1/2010 Smith
2010/0026201 A1* 2/2010 Byun ..... G09G 3/3406 315/287
2010/0085375 A1 4/2010 Chung et al.
2011/0109537 A1 5/2011 Uguen et al.
2011/0140621 A1* 6/2011 Yi ..... H05B 33/0854 315/224
2012/0229110 A1* 9/2012 Huang ..... H02M 3/1582 323/282

FOREIGN PATENT DOCUMENTS

WO 2012061052 5/2010

* cited by examiner

*Primary Examiner* — Jimmy Vu
*Assistant Examiner* — Henry Luong
(74) *Attorney, Agent, or Firm* — Treyz Law Group, P.C.; Jason Tsai; Zachary D. Hadd

(57) ABSTRACT

An electronic device may be provided with display circuitry that includes a display timing controller, a backlight driver, a light source, and other associated backlight structures. The backlight control circuitry may generate a control signal having an adjustable duty cycle to the backlight driver. The backlight driver may include a boost converter, a current driver, and backlight control circuitry. The current driver may only be activated when the control signal is high. The backlight control circuitry may output an enable signal to the boost converter. The backlight control circuitry may activate the boost converter a predetermined amount of time before each rising clock edge in the control signal by asserting the enable signal for a longer period of time than when the control signal is high. The control signal and the enable signal may be deasserted at around the same times.

19 Claims, 10 Drawing Sheets

| LOAD TYPE | PWM DUTY CYCLE | CURRENT DELIVERED |
|---|---|---|
| LIGHT | 0-30% | 0-60 mA |
| MEDIUM | 30-70% | 60-140 mA |
| HEAVY | 70-100% | 140-200 mA |

FIG. 11

METHODS AND APPARATUS FOR IMPROVING BACKLIGHT DRIVER EFFICIENCY

This application claims priority to U.S. provisional patent application No. 61/734,906 filed Dec. 7, 2012, which is hereby incorporated by reference herein in its entirety.

BACKGROUND

This relates generally to displays, and more particularly, to displays with backlights.

Displays such as liquid crystal displays and other displays sometimes include backlight units. A backlight unit may include an array of light-emitting diodes and a backlight control integrated circuit (sometimes referred to as a backlight driver) that directly controls the array of light-emitting diodes. Displays with backlight units may be incorporated into an electronic device such as a computer or cellular telephone or may be implemented as stand-alone units.

The backlight driver may include a boost converter circuit and a current driver circuit. The boost converter circuit is controlled using a first clock signal exhibiting a first frequency to periodically provide a boosted voltage to the array of light-emitting diodes when the first clock signal is high. The current driver circuit is controlled using a second clock signal exhibiting a second frequency to periodically provide a source of current for the light-emitting diodes when the second clock signal is high. The first frequency associated with the first clock signal that controls the boost converter is typically substantially greater than the second frequency associated with the second clock signal that controls the current driver circuit. When the second clock signal is low, the current driver circuit is turned off, thereby preventing the array of light-emitting diodes from emitting any light.

In conventional backlight drivers, the first clock signal continues to toggle during both high clock phases and low clock phases of the second clock. In other words, the boost converter circuit is being continuously switched on and switched off even when the current driver circuit is turned off. Operating the backlight driver in this way consumes more power than necessary. Since the power consumption associated with switching on/off the boost converter circuit does not scale with the amount of current that is being delivered using the current driver circuit, power efficiency degradation is exacerbated at lower loads when the current driver is being used to deliver lower average current levels (i.e., when the backlight driver is being used to produce lower backlight levels).

It would therefore be desirable to be able to provide improved ways for operating the backlight driver to improve power efficiency.

BRIEF DESCRIPTION OF THE DRAWINGS

FIG. 11 is a table illustrating different current driver loading scenarios in accordance with an embodiment of the present invention.

SUMMARY

Embodiments of the present invention relate to reducing boost converter switching events during periods when a current driver is turned off and making appropriate predictions on when the current drivers will be turned on to precondition the boost converter.

An electronic device may include a display having a display backlight unit (sometimes referred to as display backlight circuitry). The display backlight unit may include a boost converter circuit, a current driver circuit, backlight driver control circuitry, light emitting structures (e.g., an array of light-emitting diodes, etc.), and other associated structures. The light emitting structures may be coupled in series between the boost converter circuit and the current driver circuit. The boost converter circuit may be used to provide a boosted voltage signal to the light emitting structures, whereas the current driver circuit may be used to provide current to the light emitting structures.

The current driver may be periodically activated using a first clock control signal, whereas the boost converter may be periodically activated using a second clock control signal. The first and second clock control signals may exhibit the same frequency. The control circuitry may output the first clock signal based on the second control signal. In particular, the control circuitry may have an input that receives the first clock control signal and an output on which the second clock control signal is provided. The backlight level of the display may be adjusted by tuning the duty cycle of the first clock control signal.

In one suitable arrangement, the control circuitry may assert the second control signal to activate the boost converter circuit before each respective rising edge in the first control signal. The control circuitry may then deassert the second control signal in response to detecting falling edges in the first control signal. In other words, the first and second control signals may exhibit different duty cycles (e.g., the second control signal may exhibit a duty cycle that is greater than that of the first control signal).

Further features of the present invention, its nature and various advantages will be more apparent from the accompanying drawings and the following detailed description.

DETAILED DESCRIPTION

Electronic devices may include displays. The displays may be used to display images to a user. Illustrative electronic devices that may be provided with displays are shown in FIGS. 1, 2, and 3.

Figure 1:
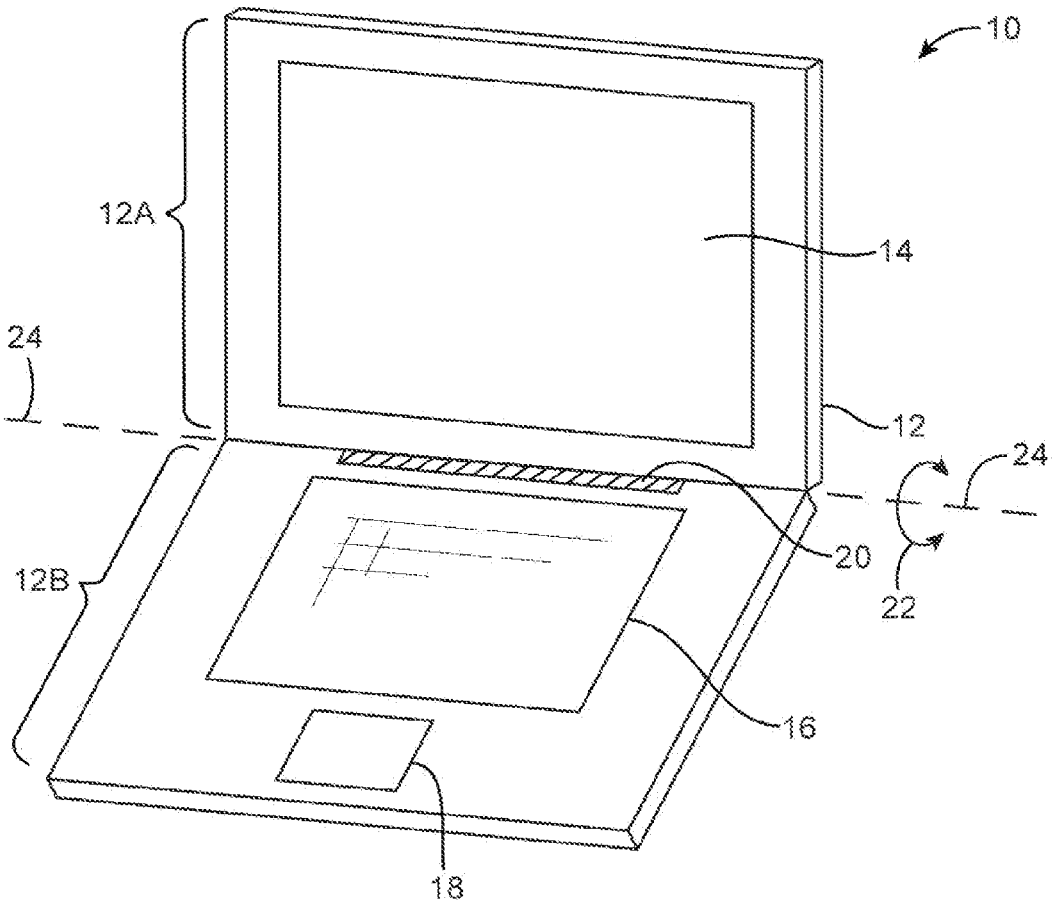
FIG. 1 is a perspective view of an illustrative electronic device such as a laptop computer with a display in accordance with an embodiment of the present invention.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24.

Figure 2:
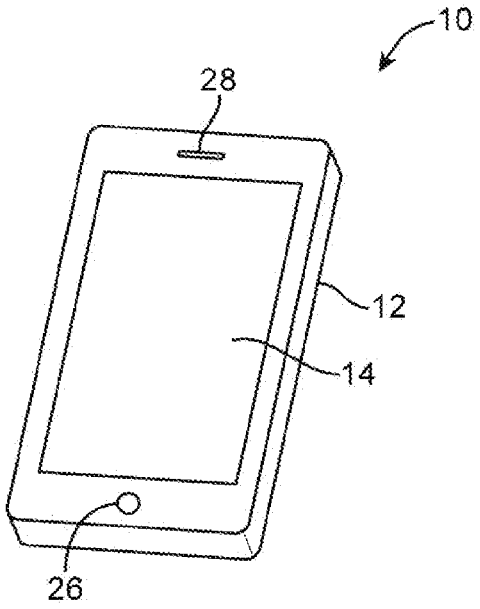
FIG. 2 is a perspective view of an illustrative electronic device such as a handheld electronic device with a display in accordance with an embodiment of the present invention.

FIG. 2 shows how electronic device 10 may be a handheld device such as a cellular telephone, music player, gaming device, navigation unit, or other compact device. In this type of configuration for device 10, housing 12 may have opposing front and rear surfaces. Display 14 may be mounted on a front face of housing 12. Display 14 may, if desired, have a display cover layer or other exterior layer that includes openings for components such as button 26. Openings may also be formed in a display cover layer or other display layer to accommodate a speaker port (see, e.g., speaker port 28 of FIG. 2).

Figure 3:
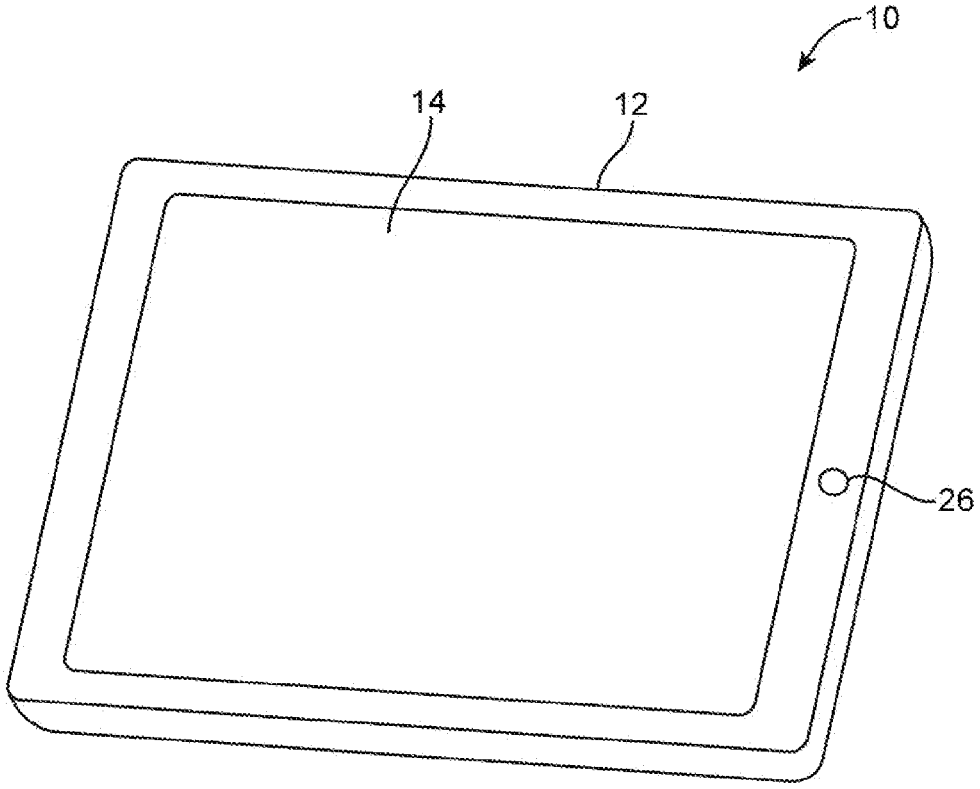
FIG. 3 is a perspective view of an illustrative electronic device such as a tablet computer with a display in accordance with an embodiment of the present invention.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have a cover layer or other external layer with an opening to accommodate button 26 (as an example).

The illustrative configurations for device 10 that are shown in FIGS. 1, 2, and 3 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Displays for device 10 may, in general, include image pixels formed from light-emitting diodes (LEDs), organic LEDs (OLEDs), plasma cells, electrowetting pixels, electrophoretic pixels, liquid crystal display (LCD) components, or other suitable image pixel structures. In some situations, it may be desirable to use LCD components to form display 14, so configurations for display 14 in which display 14 is a liquid crystal display are sometimes described herein as an example. It may also be desirable to provide displays such as display 14 with backlight structures, so configurations for display 14 that include a backlight unit may sometimes be described herein as an example. Other types of display technology may be used in device 10 if desired. The use of liquid crystal display structures and backlight structures in device 10 is merely illustrative.

A display cover layer may cover the surface of display 14 or a display layer such as a color filter layer or other portion of a display may be used as the outermost (or nearly outermost) layer in display 14. A display cover layer or other outer display layer may be formed from a transparent glass sheet, a clear plastic layer, or other transparent member.

Touch sensor components such as an array of capacitive touch sensor electrodes formed from transparent materials such as indium tin oxide may be formed on the underside of a display cover layer, may be formed on a separate display layer such as a glass or polymer touch sensor substrate, or may be integrated into other display layers (e.g., substrate layers such as a thin-film transistor layer).

Figure 4:
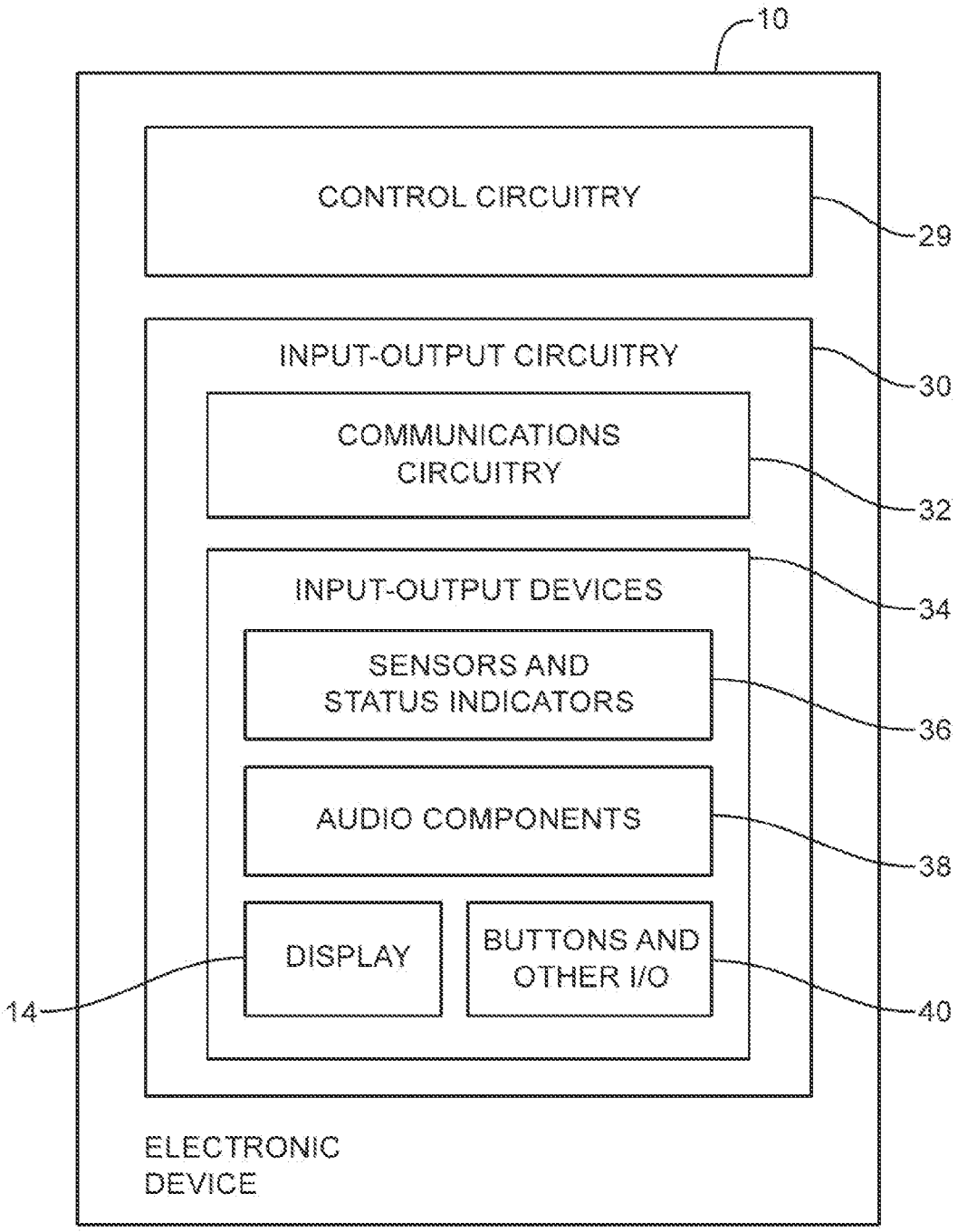
FIG. 4 is a schematic diagram of an illustrative electronic device with a display in accordance with an embodiment of the present invention.

A schematic diagram of an illustrative configuration that may be used for electronic device 10 is shown in FIG. 4. As shown in FIG. 4, electronic device 10 may include control circuitry 29. Control circuitry 29 may include storage and processing circuitry for controlling the operation of device 10. Control circuitry 29 may, for example, include storage such as hard disk drive storage, nonvolatile memory (e.g., flash memory or other electrically-programmable-read-only memory configured to form a solid state drive), volatile memory (e.g., static or dynamic random-access-memory), etc. Control circuitry 29 may include processing circuitry based on one or more microprocessors, microcontrollers, digital signal processors, baseband processors, power management units, audio codec chips, application specific integrated circuits, etc.

Control circuitry 29 may be used to run software on device 10, such as operating system software and application software. Using this software, control circuitry 29 may present information to a user of electronic device 10 on display 14. When presenting information to a user on display 14, sensor signals and other information may be used by control circuitry 29 in making adjustments to the strength of backlight illumination that is used for display 14.

Input-output circuitry 30 may be used to allow data to be supplied to device 10 and to allow data to be provided from device 10 to external devices. Input-output circuitry 30 may include communications circuitry 32. Communications circuitry 32 may include wired communications circuitry for supporting communications using data ports in device 10. Communications circuitry 32 may also include wireless communications circuits (e.g., circuitry for transmitting and receiving wireless radio-frequency signals using antennas).

Input-output circuitry 30 may also include input-output devices 34. A user can control the operation of device 10 by supplying commands through input-output devices 34 and may receive status information and other output from device 10 using the output resources of input-output devices 34.

Input-output devices 34 may include sensors and status indicators 36 such as an ambient light sensor, a proximity sensor, a temperature sensor, a pressure sensor, a magnetic sensor, an accelerometer, and light-emitting diodes and other components for gathering information about the environment in which device 10 is operating and providing information to a user of device 10 about the status of device 10.

Audio components 38 may include speakers and tone generators for presenting sound to a user of device 10 and microphones for gathering user audio input.

Display 14 may be used to present images for a user such as text, video, and still images. Sensors 36 may include a touch sensor array that is formed as one of the layers in display 14.

User input may be gathered using buttons and other input-output components 40 such as touch pad sensors, buttons, joysticks, click wheels, scrolling wheels, touch sensors such as sensors 36 in display 14, key pads, keyboards, vibrators, cameras, and other input-output components.

Figure 5:
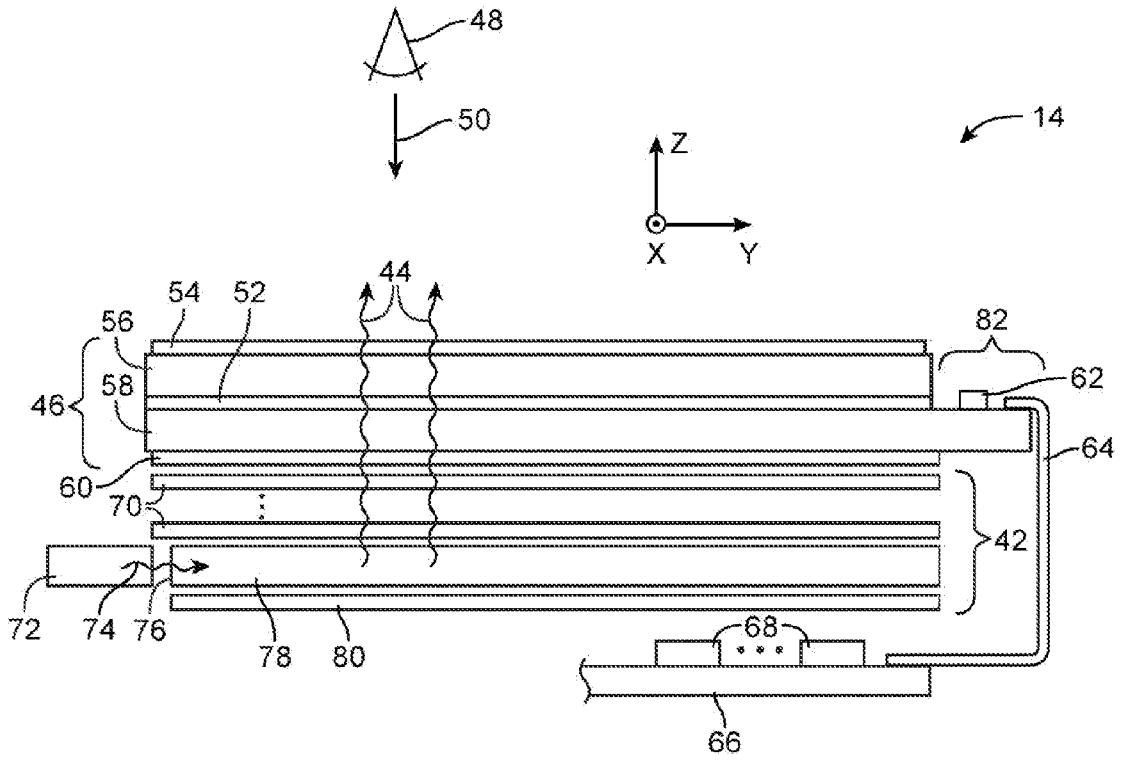
FIG. 5 is a cross-sectional side view of an illustrative display in accordance with an embodiment of the present invention.

A cross-sectional side view of an illustrative configuration that may be used for display 14 of device 10 (e.g., for display 14 of the devices of FIG. 1, FIG. 2, or FIG. 3 or other suitable electronic devices) is shown in FIG. 5. As shown in FIG. 5, display 14 may include backlight structures such as backlight unit 42 for producing backlight 44. During operation, backlight 44 travels outwards (vertically upwards in dimension Z in the orientation of FIG. 5) and passes through display pixel structures in display layers 46. This illuminates any images that are being produced by the display pixels for viewing by a user. For example, backlight 44 may illuminate images on display layers 46 that are being viewed by viewer 48 in direction 50.

Display layers 46 may be mounted in chassis structures such as a plastic chassis structure and/or a metal chassis structure to form a display module for mounting in housing 12 or display layers 46 may be mounted directly in housing 12 (e.g., by stacking display layers 46 into a recessed portion in housing 12). Display layers 46 may form a liquid crystal display or may be used in forming displays of other types.

In a configuration in which display layers 46 are used in forming a liquid crystal display, display layers 46 may include a liquid crystal layer such a liquid crystal layer 52. Liquid crystal layer 52 may be sandwiched between display layers such as display layers 58 and 56. Layers 56 and 58 may be interposed between lower polarizer layer 60 and upper polarizer layer 54.

Layers 58 and 56 may be formed from transparent substrate layers such as clear layers of glass or plastic. Layers 56 and 58 may be layers such as a thin-film transistor layer and/or a color filter layer. Conductive traces, color filter elements, transistors, and other circuits and structures may be formed on the substrates of layers 58 and 56 (e.g., to form a thin-film transistor layer and/or a color filter layer). Touch sensor electrodes may also be incorporated into layers such as layers 58 and 56 and/or touch sensor electrodes may be formed on other substrates.

With one illustrative configuration, layer 58 may be a thin-film transistor layer that includes an array of thin-film transistors and associated electrodes (display pixel electrodes) for applying electric fields to liquid crystal layer 52 and thereby displaying images on display 14. Layer 56 may be a color filter layer that includes an array of color filter elements for providing display 14 with the ability to display color images. If desired, layer 58 may be a color filter layer and layer 56 may be a thin-film transistor layer.

During operation of display 14 in device 10, control circuitry 29 (e.g., one or more integrated circuits such as components 68 on printed circuit 66 of FIG. 5) may be used to generate information to be displayed on display (e.g., display data). The information to be displayed may be conveyed from circuitry 68 to display driver integrated circuit 62 using a signal path such as a signal path formed from conductive metal traces in flexible printed circuit 64 (as an example).

Display driver integrated circuit 62 may be mounted on thin-film-transistor layer driver ledge 82 or elsewhere in device 10. A flexible printed circuit cable such as flexible printed circuit 64 may be used in routing signals between printed circuit 66 and thin-film-transistor layer 58. If desired, display driver integrated circuit 62 may be mounted on printed circuit 66 or flexible printed circuit 64. Printed circuit 66 may be formed from a rigid printed circuit board (e.g., a layer of fiberglass-filled epoxy) or a flexible printed circuit (e.g., a flexible sheet of polyimide or other flexible polymer layer).

Backlight structures 42 may include a light guide plate such as light guide plate 78. Light guide plate 78 may be formed from a transparent material such as clear glass or plastic. During operation of backlight structures 42, a light source such as light source 72 may generate light 74. Light source 72 may be, for example, an array of light-emitting diodes.

Light 74 from light source 72 may be coupled into edge surface 76 of light guide plate 78 and may be distributed in dimensions X and Y throughout light guide plate 78 due to the principal of total internal reflection. Light guide plate 78 may include light-scattering features such as pits or bumps. The light-scattering features may be located on an upper surface and/or on an opposing lower surface of light guide plate 78.

Light 74 that scatters upwards in direction Z from light guide plate 78 may serve as backlight 44 for display 14. Light 74 that scatters downwards may be reflected back in the upwards direction by reflector 80. Reflector 80 may be formed from a reflective material such as a layer of white plastic or other shiny materials.

To enhance backlight performance for backlight structures 42, backlight structures 42 may include optical films 70. Optical films 70 may include diffuser layers for helping to homogenize backlight 44 and thereby reduce hotspots, compensation films for enhancing off-axis viewing, and brightness enhancement films (also sometimes referred to as turning films) for collimating backlight 44. Optical films 70 may overlap the other structures in backlight unit 42 such as light guide plate 78 and reflector 80. For example, if light guide plate 78 has a rectangular footprint in the X-Y plane of FIG. 5, optical films 70 and reflector 80 may have a matching rectangular footprint.

Figure 6:
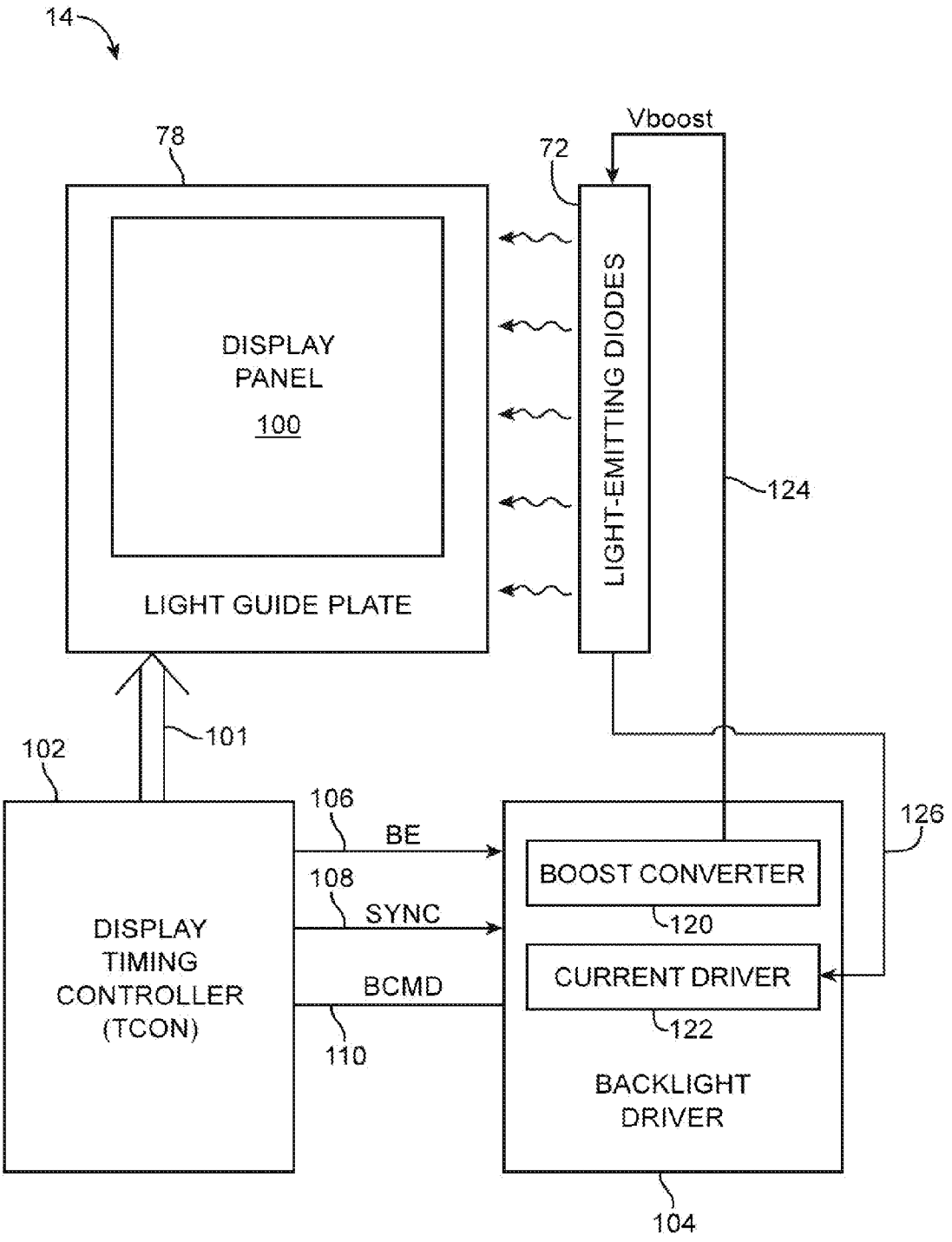
FIG. 6 is a schematic diagram of illustrative display circuitry that includes a boost converter circuit and a current driver circuit in accordance with an embodiment of the present invention.

FIG. 6 is a schematic diagram of display 14. As shown in FIG. 6, display 14 may include a display panel such as display panel 100, timing controller (ICON) circuitry such as display timing controller 102 (e.g., a ICON integrated circuit), and associated backlight structures. Display panel 100 may be a liquid crystal display module containing an array of display pixels, an electrophoretic display, an electrowetting display, or display structures using other types of display technologies. The backlight structures may include light guide plate 78, light source 72 (e.g., an array of light-emitting diodes), and backlight control circuitry such as backlight controller 104 (sometimes referred to as a backlight driver integrated circuit) that is used to control light source 72. Light guide plate 78, light source 72, backlight controller 122, and other associated circuitry may sometimes be referred to collectively as a backlight unit or as display backlight structures.

Display timing controller 102 may be used to provide data signals and control signals to display panel 100 via path 101. As an example, timing controller 102 may provide data signals via data lines and gate control signals via gate lines to each corresponding display pixel in display panel 100 via path 101. Control signals such as backlight enable control signal BE and display synchronization signals SYNC may be conveyed from display timing controller 102 to backlight driver 104 via paths 106 and 108, respectively. When backlight enable signal BE is asserted, backlight driver 104 may be capable of turning light source 72 on to illuminate the display panel via light guide plate 78. When backlight enable signal BE is deasserted, backlight driver 122 may be unable to turn light source 72 on.

In the example of FIG. 6, backlight driver 104 may include a boost converter such as boost converter 120 for providing elevated voltage signals that are used to drive the array or chain of light-emitting diodes in light source 72 (e.g., by providing a boosted voltage signal Vboost to light source 72 via path 124).

Backlight driver 104 may also include a current driver 122 that provides current to light source 72 via current path 126. For example, current driver 122 may serve as a current sink that is periodically enabled using a pulse width modulated control signal PWM (shown in FIG. 7). Signal PWM may be generated by the backlight driver control circuitry 200 acting on a brightness command BCMD from timing controller 102 received via path 110. To achieve the desired backlight level, the pulse width of signal PWM is modulated (e.g., by adjusting the duty cycle of signal PWM).

For example, signal PWM may exhibit a first duty cycle during a first time period and may exhibit a second duty cycle that is different from the first duty cycle during a second time period following the first time period. A larger duty cycle may activate current driver 122 for a longer period of time to result in a higher backlight level, whereas a smaller duty cycle may activate current driver 122 for a relatively shorter period of time to result in a lower backlight level (e.g., the brightness of display 14 may be proportional to the duty cycle of signal PWM that controllers current driver 122). The use of PWM to control backlight brightness level may sometimes be referred to as PWM "dimming." If desired, the backlight level can also be controlled by tuning the rate of current flow that is provided by current driver 122 when current driver 122 is activated. The use of current flow to control backlight brightness level may sometimes be referred to as "linear dimming."

Figure 7:
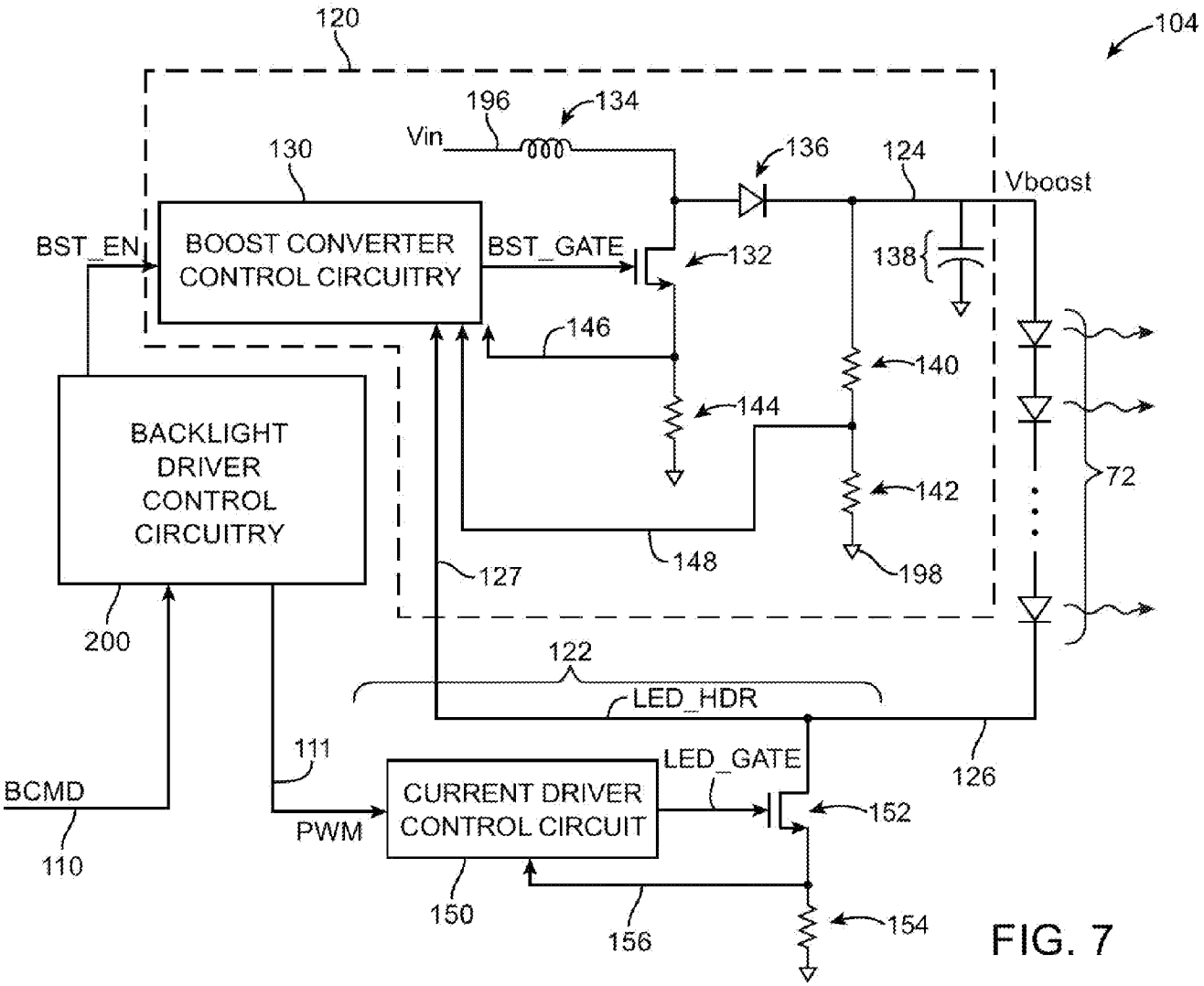
FIG. 7 is a circuit diagram of illustrative backlight driver circuitry in accordance with an embodiment of the present invention.

FIG. 7 is a circuit diagram of backlight driver 104. As shown in FIG. 7, backlight driver 104 may include boost converter circuitry 120, current driver circuitry 122, and associated backlight driver control circuitry 200. Boost converter circuitry 120 may include a boost converter control circuit 130, a transistor such as gating transistor 132 (e.g., an n-channel transistor), a diode such as diode 136, a capacitive element such as capacitor 138, an inductive element such as inductor 134, and resistive elements such as resistors 140, 142, and 144. Transistor 132 may have a drain terminal that is coupled to a positive power supply terminal 196 (e.g., a power supply terminal on which power supply voltage Vin is provided) via inductor 134, a source terminal that is coupled to a ground power supply terminal via resistor 144, and a gate terminal that receives voltage boost converter gating control signal BST_GATE. The source terminal of transistor 132 may also be coupled back to boost converter control circuit via a feedback path 146.

The drain terminal of transistor 132 may further be coupled to a boost converter output path 124 via diode 136. Boost converter circuitry 120 may be used to generate boosted voltage Vboost on output path 124. Resistors 140 and 142 may be coupled in series between output path 124 and the ground terminal. In particular, resistors 140 and 142 may be connected at an intermediate node that is coupled back to boost converter control circuit 130 via another feedback path 148. Capacitive element 138 may be coupled to output path 124 in a shunt configuration.

Boost converter control circuit 130 may be configured to toggle control signal BST_GATE at a first frequency. When signal BST_GATE is asserted, transistor 132 is turned on so that current may flow through diode 136 to charge up capacitor 124 towards a regulated voltage level. Consider an example in which power supply voltage is equal to 12 V. By choosing appropriate values for the different passive components in circuitry 120, circuitry 120 may be configured to provide a Vboost of 60 V on output path 124 (as an example). When signal BST_GATE is deasserted, transistor 132 is turned off and output path 124 may be left floating such that output path 124 is not actively being driven. In this floating state, the voltage level on output path 124 may be temporarily stored on capacitive element 138.

Current driver circuitry 122 may include a current driver control circuit 150, a transistor such as gating transistor 152 (e.g., an n-channel transistor), and a resistive element such as resistor 154. In particular, transistor 152 may have a drain terminal that is coupled to current sink path 126, a source terminal that is coupled to the ground line via resistor 154, and a gate terminal that receives gating control signal LED_GATE. The source terminal of transistor 152 may also be coupled back to current driver control circuit 150 via feedback path 156.

The string of LEDs in light source 72 may be coupled in series between output path 124 and current sink path 126. Path 126 may also be coupled to boost converter control circuit 130 via path 127 to help ensure that sufficient headroom is provided to current driver 122 (e.g., the voltage on path 126 may serve as headroom information LED_HDR that is fed back to boost converter control circuit 130 as a control signal). Connected using this arrangement, light source 72 may be configured to emit light when transistor 152 is activated and may be turned off when transistor 152 is deactivated. Transistor 152 may be activated when signal LED_GATE is asserted and may be deactivated when signal LED_GATE is deasserted. The amount of current that is delivered by current driver circuitry 122 may therefore depend on the frequency and/or duration with which signal LED_GATE is asserted.

Current driver control circuit 150 may receive signal PWM from backlight driver control circuitry 200 via path 111. The frequency and duration with which signal LED_GATE is asserted may be directly proportional to the frequency and duty cycle of signal PWM, as controlled by backlight driver control circuitry 200. In other words, light source 72 may only be capable of emitting light when signal LED_GATE or signal PWM is asserted. Generally, signal PWM may be toggled at a second frequency that is substantially less than the first frequency at which signal BST_GATE is being toggled. As an example, signal BST_GATE may toggle at 400 kHz whereas signal PWM may only toggle at 20 kHz.

Boost converter circuitry 120 and current driver circuitry 122 of FIG. 7 are merely illustrative and do not serve to limit the scope of the present invention. If desired, other suitable types of voltage boosting circuit and other types of current source/sink circuit may be used in backlight driver integrated circuit 104.

Backlight driver control circuitry 200 may have an input configured to receive brightness information (e.g., brightness control command BCMD) from ICON and an output on which it will generate a PWM signal and another output on which a boost converter enable signal BST_EN is provided. Backlight driver control circuitry 200 may serve to toggle BST_EN based on when signal PWM rises high and when signal PWM falls low. When signal BST_EN is asserted, boost converter circuitry 120 may be allowed to toggle signal BST_GATE at the first frequency (i.e., at a boost converter switching frequency) to periodically charge up output voltage Vboost. When signal BST_EN is deasserted, boost converter circuitry 120 may be placed in an idle state such that BST_GATE is held low (e.g., output path 124 may remain floating while signal BST_EN is deasserted).

Figure 8:
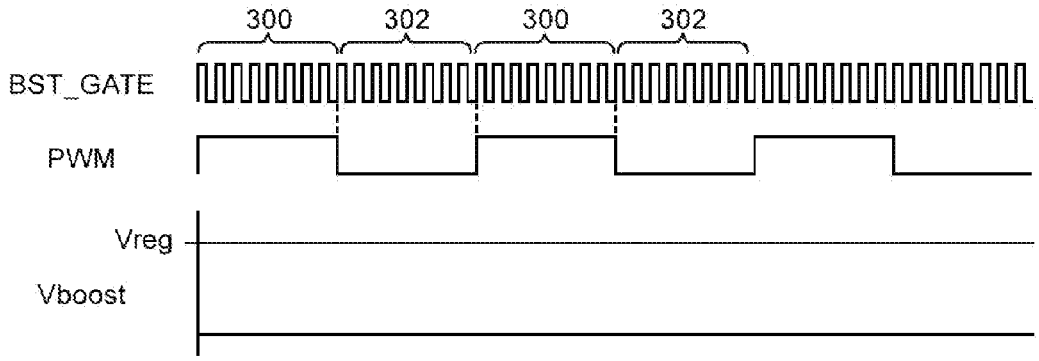
(PRIOR ART) FIG. 8
FIGS. 8 and 9 are timing diagrams showing conventional boost converter switching schemes.

In conventional backlight drivers, the boost converter circuitry may continue to switch on and off during both high and low clock phases of signal PWM (see, FIG. 8). As shown in FIG. 8, signal BST_GATE continues to toggle during the high clock phases 300 and the low clock phases 302 of PWM. Voltage Vboost is kept at a regulated voltage level Vreg. In other words, boost converter 120 is being continuously switched on and switched off even when current driver 122 is turned off. Operating the backlight driver in this way consumes more power than necessary.

Figure 9:
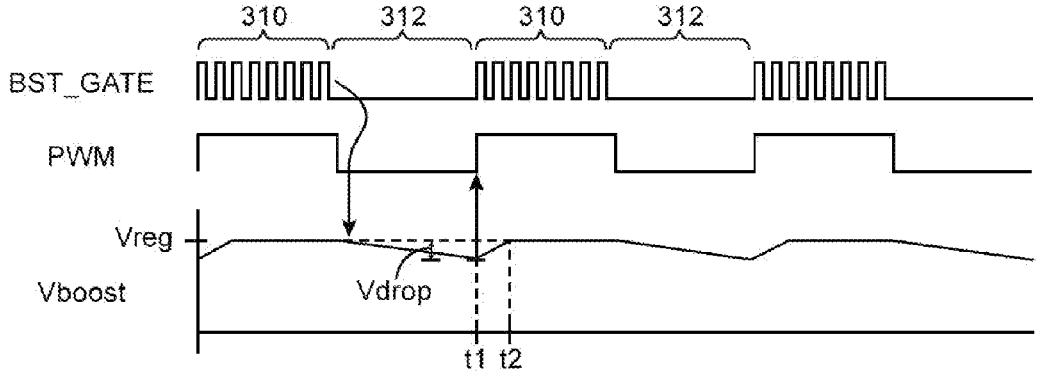
(PRIOR ART) FIG. 9

In an effort to lower power consumption, techniques have been developed to reduce boost converter switching events during periods when the current driver is turned off. FIG. 9 shows an approach in which signal BST_GATE is prevented from toggling during the low clock phases 312 of signal PWM (i.e., BST_GATE is only allowed to toggle when signal PWM is asserted during high clock phases 310). Operating the boost converter in this way may, however, result in some voltage droop in Vboost at the rising edges of PWM. In the example of FIG. 9, voltage Vboost may suffer a voltage offset Vdroop from the desired voltage level Vreg when signal PWM is turned back on at time t1. It may take some time before Vboost is recharged up to Vreg (at time t2). During this time when Vboost is being charged back up to Vreg (i.e., from time t1 to t2), the current driver may not have sufficient headroom and may not be capable of providing an accurate current to the array of backlight LEDs.

Figure 10:
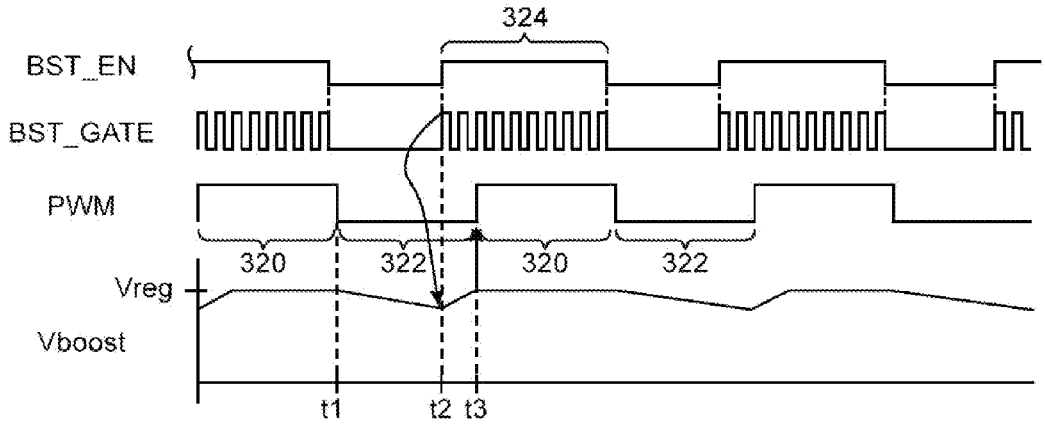
FIG. 10 is a timing diagram showing illustrative boost converter switching schemes for improving power efficiency in accordance with an embodiment of the present invention.

In accordance with an embodiment of the present invention, boost converter circuitry 120 may be activated prior to each rising edge in signal PWM (see, e.g., FIG. 10). As shown in FIG. 10, the enabling of signal BST_GATE may be controlled using boost converter enabling signal BST_EN (e.g., boost converter switching signal BST_GATE can only toggle when signal BST_EN is asserted). Backlight driver control circuitry 200 may assert BST_EN a predetermined number of cycles before PWM is asserted. In the example of FIG. 10, signal BST_EN is deasserted in response to a corresponding falling clock edge in PWM (at time t1 towards the end of PWM high clock phase 320). signal BST_EN may be asserted (at time t2) two boost converter switching cycles before the corresponding rising clock edge of PWM (e.g., BST_EN may be asserted two BST_GATE clock cycles before time t3 when PWM is raised high). This is merely illustrative.

Signal BST_EN may be asserted any suitable number of boost converter switching cycles before each respective rising edge of signal PWM. In this way, backlight driver control circuitry 200 may assert BST_EN for time periods 324 that are greater than the high clock phases 320 of PWM (e.g., the duty cycle of BST_EN may be greater than the duty cycle of PWM). Generally, enough time should be allowed for boost converter 120 to recharge capacitor 138 on which Vboost is provided so as to eliminate any existing voltage droop before the rising edge of PWM. The number of boost converter switching cycles that should be allowed before the rising edge of PWM is a function of various circuit component parameters associated with the boost converter circuitry. The number of boost converter switching cycles may be adjustable/programmable for use in various applications.

For example, consider a scenario in which signal PWM has a frequency of 20 kHz and the boost converter is switching at a frequency of 400 kHz (e.g., signal BST_GATE is toggling at 400 kHz). If the desired LED backlight level is set at 50%, then the display timing controller may adjust signal PWM to exhibit a 50% duty cycle (e.g., PWM may be a square wave with a 25 μs high clock phase and a 25 μs low clock phase). During one complete PWM cycle, the boost converter may switch up to 20 times if no deactivation of boost converter switching is implemented (i.e., 10 times during the high PWM clock phase and 10 times during the low PWM clock phase).

In accordance with an embodiment of the present invention, by preventing boost converter from switching during the PWM low clock phases 322 and by starting the PWM switching two cycles before the rising edge of signal PWM, eight switching events are eliminated and thus reduces switching loses by 40% (as an example). The amount of power savings generally increases for lower backlight levels (e.g., for lower loads or PWM duty cycles).

Deactivating the boost converter switching activity in this way may serve to improve the power efficiency of display 14, in particular at "mid" to "light" load conditions. FIG. 11 is a table illustrating different types of loading conditions. In the example of FIG. 11, current driver 122 may be configured to provide up to 60 mA of current when the duty cycle of PWM is set between zero and 30 percent, to provide between 60 mA and 140 mA of current when the duty cycle of PWM is set between 30 and 70 percent, and to provide up to 200 mA of current when the duty cycle of PWM is set between 70 and 100 percent.

When the amount of current that is delivered to light source 72 is within the first range (e.g., between zero and 60 mA), the current driver may be considered as being used to drive a "light" load, which corresponds to a relatively low backlight brightness level. When the amount of current that is delivered to light source 72 is within the second range (e.g., between 60 mA and 140 mA), the current driver may be considered as being used to drive a "medium" load, which corresponds to an intermediate backlight brightness level. When the amount of current that is delivered to light source 72 is within the third range (e.g., between 140 mA and 200 mA), the current driver may be considered as being used to drive a "heavy" load, which corresponds to a relatively high backlight brightness level. The different types of load conditions directly affect the amount of power consumed by current driver circuitry 122.

Part of the power that is consumed by boost converter circuitry 120 may be independent of the current load condition. Specifically switching losses are for the most part independent of current load condition. The boost converter may, as an example, consume 5 mA of current whether or not the current driver is being used to drive a light load, medium load, or heavy load. The overall power efficiency of display 14 may depend on the combined power efficiency of the boost converter and the current driver. Since the amount of savings provided by reducing boost converter switching activity is fixed, the improvement offered by this approach is magnified at light to mid load conditions as the amount of power savings represents a larger percentage of the total power consumption at lighter load levels.

Figure 12:
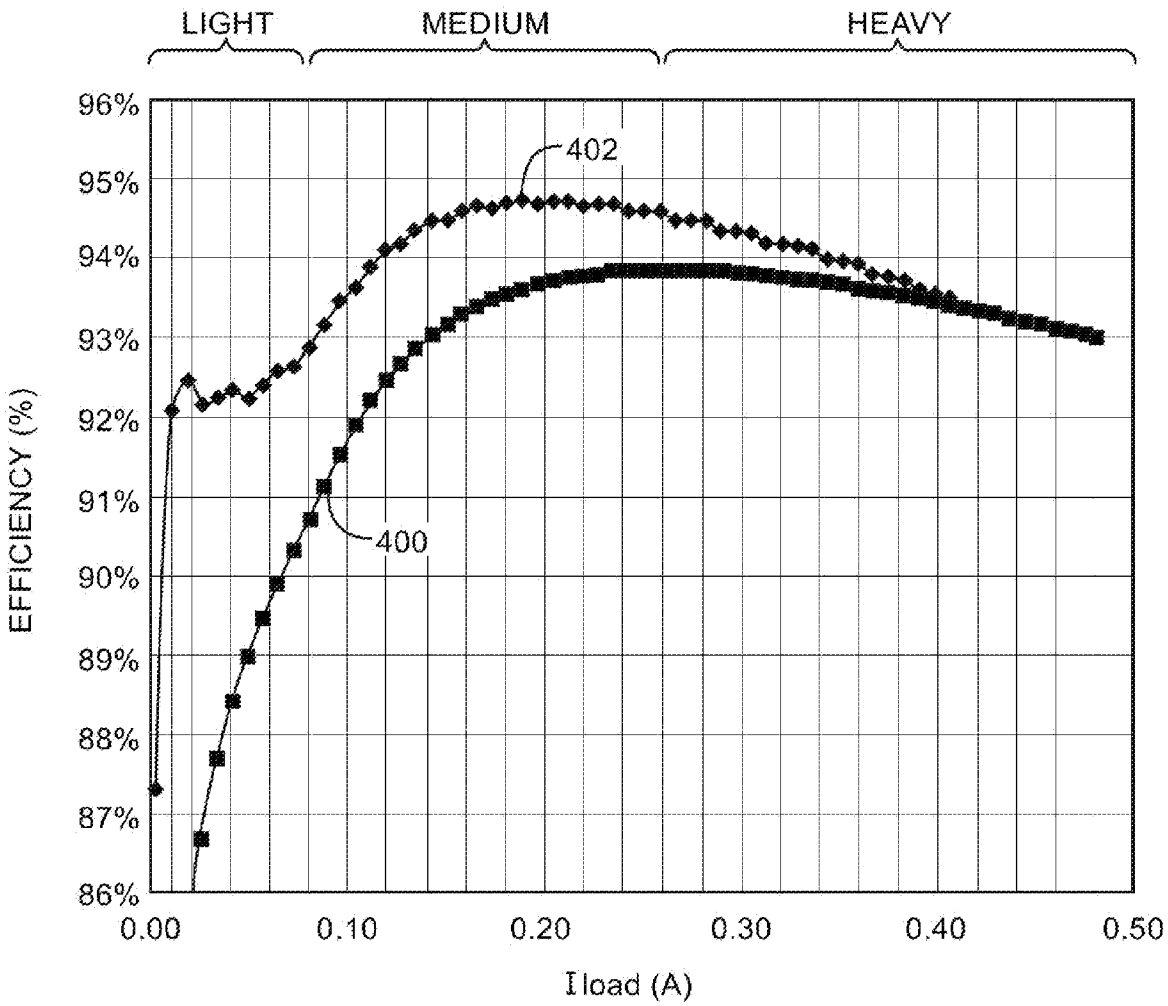
FIG. 12 is a plot of efficiency versus different load conditions for comparing a conventional boost converter switching scheme to an improved boost converter switching scheme in accordance with an embodiment of the present invention.

FIG. 12 is a diagram plotting display power efficiency versus different load conditions. Curve 400 may correspond to conventional boost converter switching schemes in which the boost converter is allowed to continuously switch during current driver down times (e.g., signal BST_GATE continues to toggle when PWM is deasserted), whereas curve 402 may correspond to the improved boost converter switching scheme that is described in connection with FIG. 10. In the example of FIG. 12, current levels that are less than 0.1 A may be considered as light load; current levels that are between 0.1 A and 0.25 A may be considered to be medium load; whereas current levels that are greater than 0.25 A may be considered as heavy load. As shown in FIG. 12, the amount of power efficiency improvement is enhanced at light to mid loading conditions (e.g., the gap between curves 400 and 402 is most pronounced when Iload is less than 0.25 A).

Figure 13:
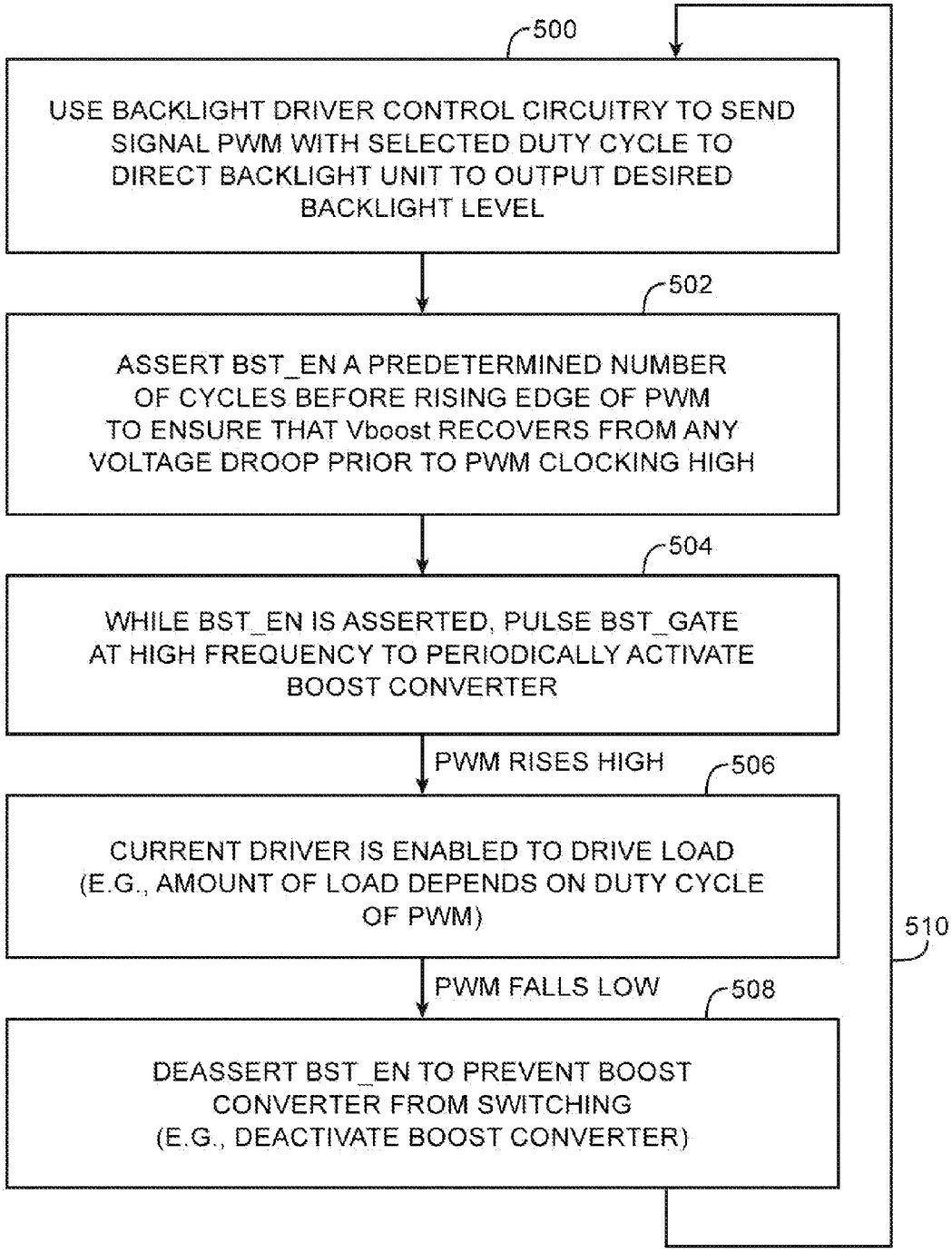
FIG. 13 is a flow chart of illustrative steps for operating backlight driver circuitry in accordance with an embodiment of the present invention.

FIG. 13 is a flow chart of illustrative steps for operating the display circuitry of FIG. 6. At step 500, backlight driver control circuitry 200 may generate signal PWM with a selected duty cycle to direct the backlight unit (e.g., backlight driver 104, light source 72, light guide plate 78, and other associated backlight structures) to output the desired backlight level.

At step 502, backlight driver control circuitry 200 may assert signal BST_EN a predetermined number of cycles before each rising edge of PWM to ensure that voltage Vboost recovers from any voltage droop (e.g., so that Vboost is properly reestablished before PWM clocks high). While BST_EN is asserted, boost converter control circuit 130 may pulse BST_GATE at the boost converter switching frequency to periodically activate boost converter circuitry 120 (at step 504). In other words, boost converter circuitry 120 may be continuously switched on/off when BST_EN is asserted.

In response to signal PWM rising high, current driver 122 may be enabled to drive the desired load (step 506). The amount of load that is currently being driven may depend on the duty cycle of PWM as determined by display timing controller 102. For example, the duty cycle of PWM may be increased to drive a higher load when outputting higher backlight levels.

In response to signal PWM falling low, backlight driver control circuitry 200 may deassert BST_EN to prevent boost converter circuitry 104 from switching (at step 508). In other words, boost converter circuitry activity may be temporarily halted while BST_EN is deasserted. Processing may then loop back to step 500, as indicated by path 510.

The foregoing is merely illustrative of the principles of this invention and various modifications can be made by those skilled in the art without departing from the scope and spirit of the invention. The foregoing embodiments may be implemented individually or in any combination.

What is claimed is:

1. A method for operating a display backlight unit having a voltage boost converter circuit and a current driver circuit, comprising:

periodically enabling the voltage boost converter circuit using an enable signal having a first frequency; and periodically activating the current driver circuit once a predetermined period of time has passed after each rising edge in the enable signal, wherein the current driver circuit is deactivated during the predetermined period of time, wherein enabling the voltage boost converter circuit comprises activating the voltage boost converter circuit using a boost converter switching control signal that exhibits a second frequency that is greater than the first frequency.

2. The method defined in claim 1, wherein the display backlight unit further includes a light source, and wherein activating the current driver circuit comprises periodically providing current to the light source.

3. The method defined in claim 1, wherein the display backlight unit further includes a light source, and wherein enabling the voltage boost converter circuit comprises periodically charging an output path that is coupled to the light source to an elevated voltage level.

4. The method defined in claim 1, wherein periodically activating the current driver circuit comprises periodically activating the current driver circuit using a control signal, the method further comprising:

controlling a backlight level for the display backlight unit by performing duty cycle adjustments on the control signal, wherein the enable signal and the control signal toggle at a given frequency.

5. The method defined in claim 4, wherein the display backlight unit further includes control circuitry, and wherein enabling the voltage boost converter circuit comprises asserting the enable signal before each rising edge in the control signal with the control circuitry.

6. The method defined in claim 5, further comprising:

with the control circuitry, deasserting the enable signal in response to falling edges in the control signal.

7. A method for operating a display backlight unit that includes a boost converter and a current driver, comprising:

asserting a first control signal to activate the current driver, wherein the first control signal has a first duty cycle; and asserting a second control signal to enable the boost converter, wherein the second control signal has a second duty cycle that is greater than the first duty cycle, wherein the first and second control signals toggle at a given frequency, wherein the first control signal is asserted after the second control signal is asserted, and wherein the first control signal is deasserted between when the second control signal is asserted and when the first control signal is asserted.

8. The method defined in claim 7, wherein the display backlight unit further includes control circuitry, the method further comprising:

with the control circuitry, generating the second control signal based on the first control signal.

9. The method defined in claim 8, further comprising:

with the control circuitry, periodically asserting the second control signal before each respective rising edge of the first control signal.

10. The method defined in claim 8, further comprising:

with the control circuitry, periodically deasserting the second control signal in response to each falling edge of the first control signal.

11. The method defined in claim 7, wherein asserting the second control signal to enable the boost converter comprises periodically asserting the second control signal to enable the boost converter, the method further comprising:

while the second control signal is asserted, continuously switching the boost converter on and off at a frequency that is at least two times greater than the given frequency.

12. The method defined in claim 7, wherein the display backlight unit further includes light source structures, the method further comprising:

while the current driver is activated, providing current to the light source structures with the current driver; and while the boost converter is activated, providing an elevated voltage to the light source structures with the boost converter.

13. The method defined in claim 7, further comprising:

controlling a backlight level for the display backlight unit by performing duty cycle adjustments on the first control signal.

14. The method defined in claim 7, wherein asserting the first control signal to activate the current driver comprises asserting the first control signal a predetermined period of time after each rising edge in the second control signal.

15. Display backlight circuitry, comprising:

a boost converter circuit that receives a first clock signal; and a current driver circuit that receives a second clock signal, wherein the first and second clock signals are asserted at different times such that the boost converter circuit is turned on and off at least once between when the first clock signal is asserted and when the second clock signal is asserted.

16. The display backlight circuitry defined in claim 15, further comprising:

backlight driver control circuitry that outputs the first clock signal to the boost converter circuit and that generates the second clock signal.

17. The display backlight circuitry defined in claim 16, wherein the first and second clock signals exhibit a given frequency, and wherein the backlight driver control circuitry is configured to assert the first clock signal before each rising clock edge in the second clock signal.

18. The display backlight circuitry defined in claim 17, wherein the backlight driver control circuitry is further configured to deassert the first clock signal when the second clock signal falls low.

19. The display backlight circuitry defined in claim 16, further comprising:

light emitting structures interposed between the boost converter circuit and the current driver circuit, wherein the boost converter circuit is configured to provide a boosted voltage signal to the light emitting structures when the first clock signal is high, and wherein the current driver circuit is configured to provide current to the light emitting structures when the second clock signal is high.

* * * * *